United States Patent [19]

Lee

[11] Patent Number: 5,054,223

[45] Date of Patent: Oct. 8, 1991

[54] BARREL LOCK ASSEMBLY FOR A GUN

[76] Inventor: Miko Lee, No. 5, Li Hsing Lane, Chung Cheng Rd., Hsin Chuang City, Taipei Hsien, Taiwan

[21] Appl. No.: 660,636

[22] Filed: Feb. 25, 1991

[51] Int. Cl.[5] ..... F41A 17/02

[52] U.S. Cl. ..... 42/70.11

[58] Field of Search ..... 42/70.11, 96

[56] References Cited

U.S. PATENT DOCUMENTS

| | | | |
|---|---|---|---|
| 37,946 | 3/1863 | Bonanzo | 42/70.11 |
| 716,946 | 12/1902 | Seoane | 42/70.11 |
| 2,478,098 | 8/1949 | Hansen | 42/70.11 |
| 2,479,107 | 8/1949 | Garretson | 42/70.11 |
| 2,530,560 | 11/1950 | Young | 42/70.11 |
| 2,836,918 | 6/1958 | Pula et al. | 42/70.11 |
| 3,154,874 | 11/1964 | Stewart | 42/70.11 |
| 4,048,741 | 9/1977 | Chiodo et al. | 42/70.11 |
| 4,512,099 | 4/1985 | Mathew | 42/70.11 |
| 4,827,649 | 5/1989 | Sheehan | 42/70.11 |
| 5,001,854 | 3/1991 | Derman | 42/70.11 |

FOREIGN PATENT DOCUMENTS

| | | | |
|---|---|---|---|
| 602163 | 7/1933 | Fed. Rep. of Germany | 42/70.11 |
| 8600396 | 1/1986 | World Int. Prop. O. | 42/70.11 |

*Primary Examiner*—Richard W. Wendtland

*Attorney, Agent, or Firm*—Fitch, Even, Tabin & Flannery

[57] ABSTRACT

A barrel lock assembly for a barrel comprises a gun lock, having a first lock and a second lock and a key having a key portion and a tubular handle. The first lock has a screw and an anchoring means. The second lock has a thread, a conical end, a cylinder which has a plurality of pins, and a column which has at least one cone. When locking with the key, the screw is rotated and the second lock is pulled toward the first lock, the conical end thereby pushes the anchoring means outwardly, thus locking the barrel. When an external load is exerted on the column, the cone abuts the pins against the barrel, thus preventing the gun lock from being knocked out of the barrel. After reaching a certain firmness the tubular handle is rotatable while the key portion remains stationary, so that the key will not be broken and the barrel will not be locked by over exertion.

3 Claims, 4 Drawing Sheets

BARREL LOCK ASSEMBLY FOR A GUN

BACKGROUND OF THE INVENTION

The present invention relates to a barrel lock assembly for a gun which has a simplified structure and is more difficult to be dislodged from of a barrel once locked.

Conventional gun locks very often possess complex structures and are incapable of resisting impact on the muzzle of the gun. Thus, it is easy for anyone other than the gun owner to shoot the gun without permission or being allowed by the gun owner. This might thereby cause safety problems for the gun owner and anyone else with access to the gun.

SUMMARY OF THE INVENTION

It is an object of the present invention to provide a simplified barrel lock assembly for a gun which firmly locks the barrel of the gun.

It is another object of the present invention to provide a barrel lock assembly for a gun, comprising a barrel lock having a first lock and a second lock, and a key that can prevent over-locking of a barrel.

It is still another object of the present invention to provide a barrel lock assembly for a gun which employs the second lock for preventing the barrel lock from being dislodged from the barrel.

These and additional objects, if not set forth specifically herein, will be readily apparent to those skilled in the art from the detailed description below, with reference of the accompanying drawings.

DETAILED DESCRIPTION OF THE INVENTION

Figure 1:
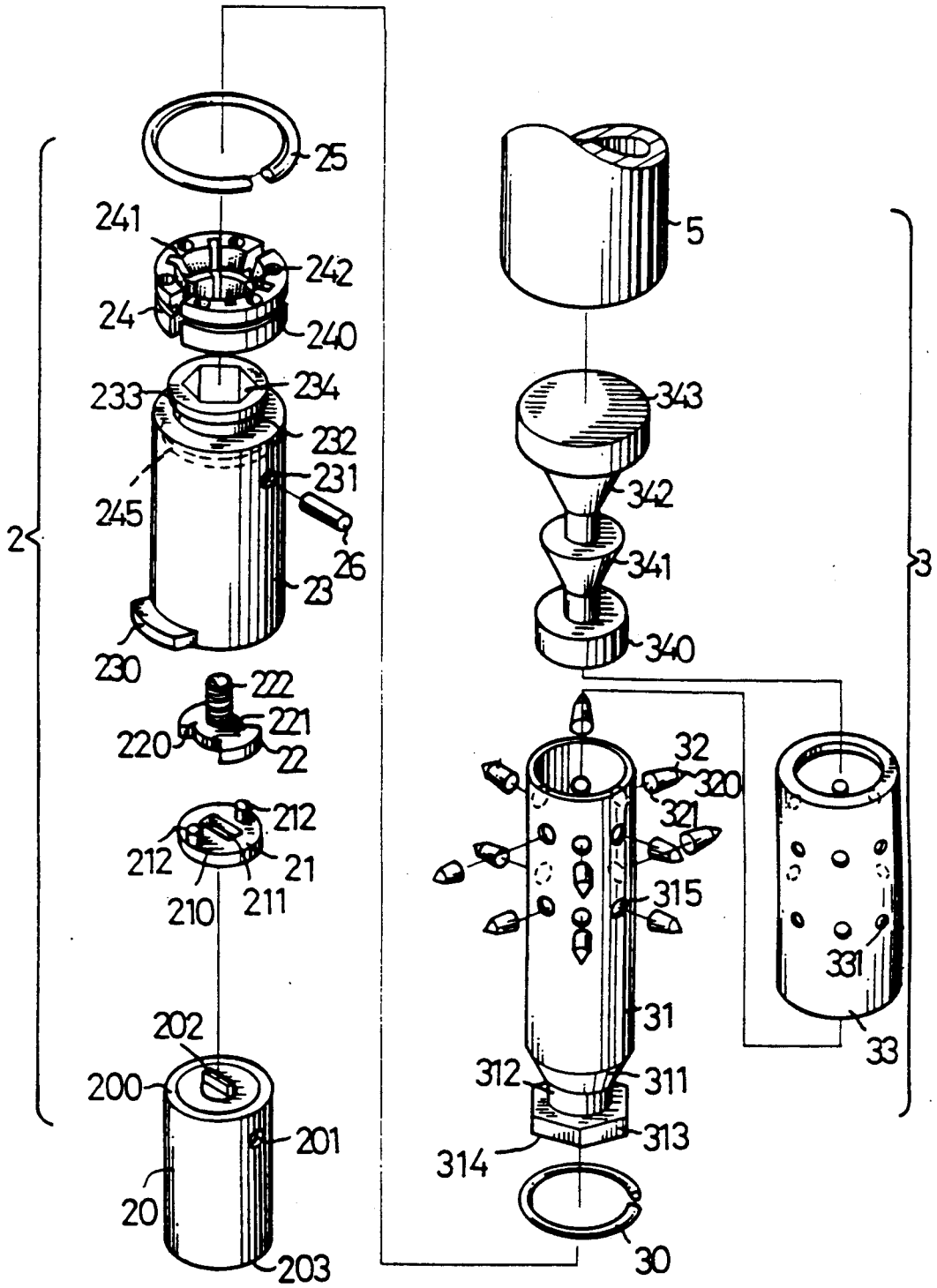
FIG. 1. is an exploded view of a barrel lock assembly in accordance with the present application.

Referring to FIG. 1, a barrel lock for a gun comprises a first lock 2 and a second lock 3. The first lock 2 has a tumbler 20, which is conventional and needs no further description, a pawl means 21, a screw means 22, a sleeve 23, two semi-circular anchoring means 24, a C-shaped flexible ring 25, and a pin 26. The second lock 3 has a C-shaped washer 30, a cylinder 31, a collar 33, a plurality of pins 32, and a column comprising members 340–343.

The tumbler 20 has a peripheral wall 200, which has a hole 201 formed thereon, an actuating end 202, and a key end 203.

The pawl means 21 has a circular pawl 210, a central linear slot 211, and two upright pegs 212 diametrically opposing.

The screw means 22 has a circular base 220, two opposite peripheral cut-outs 221, each being formed through 90° with each of the pegs 212 being slidable along one of the cut-outs 221, and an upright screw 222.

The sleeve 23 has a flange 230 extending along a portion of a periphery of a bottom portion thereof, a hole 231 on a peripheral wall thereof, a neck 232 on a top thereof, a circular flange 233 formed on the neck 232, a channel 234 which has a hexangular cross section, and a groove 245 on an inner peripheral wall of the sleeve 23.

Each semi-circular anchoring means 24 has a groove 240 on an outer peripheral wall thereof and a groove 242 on an inner peripheral wall thereof. The two semi-circular anchoring means 24 can be assembled into one, thus inner walls thereof define a conic surface 241.

The second lock 3 has a C-shaped washer 30, a cylinder 31, a plurality of pins 32, a collar 33, and a column comprising members 340–343.

The cylinder 31 has a downwardly-tapered conical end 311, a neck 312 attached thereto, a hexangular head 313 attached thereto, central threading 314 formed in the conical end 311, and a plurality of holes 315.

Each pin 32 has a first sharp end 320 and a second blunt end 321.

A collar 33 has a plurality of holes 331 on a peripheral wall thereof. Each hole 331 is corresponding to one of the holes 315 and has a smaller diameter than that of the blunt end 321.

A column has a first circular plate 340, a first cone 341 co-axially fixed thereto, a second cone 342 co-axially fixed thereto, and a second circular plate 343 co-axially fixed thereto.

Figure 2:
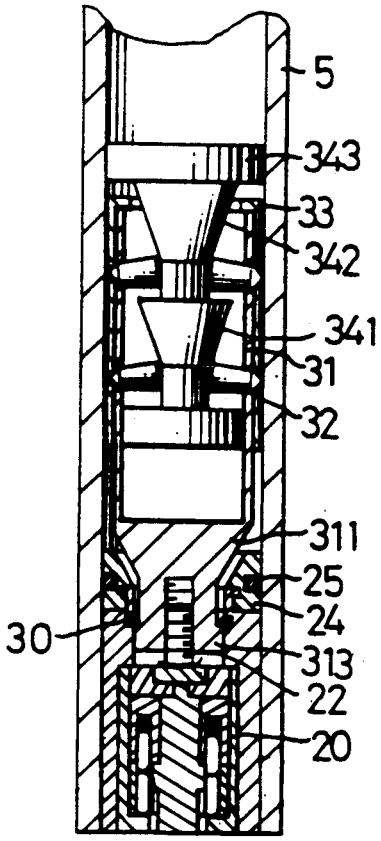
FIG. 2. is a side sectional view of the barrel lock, showing the barrel lock in an unlocked position.

Referring to FIG. 2, the pawl means 21 is mounted on the tumbler 20 with the slot 211 engaged with the flange 202 for restraining a relative rotation therebetween. The screw means 22 is then rotatably mounted on the pawl means 21 while fingers 212 are slidable along the cut-outs 221.

The tumbler 20, the pawl means 21, and the screw means 22 are then enclosed in the sleeve 23. The pin 26 is then insertable through the holes 231 and 201 for fixing them together.

The semi-circular anchoring means 24 is then mounted on the sleeve 23 with the flange 233 received in the grooves 242, and the flexible ring 25 is received in the grooves 240 for combining the semi-circular anchoring means 24 and the sleeve 23.

The column compromising members 340–343 is inserted into the cylinder 31, and each pin 32 is inserted into a hole 315 with the sharp end 320 projecting outwardly. The collar 33 then encloses the cylinder 31 with each sharp end 320 projecting through a corresponding hole 331 to prevent the pins 32 from slipping out of the cylinder 31 when the lock 1 is not inserted in a barrel.

The washer 30 is placed around but spaced from the neck 312. The hexangular head 313 is then inserted in the hexangular channel 234 with the screw 222 being engaged with the threading 314. The hexangular head 313 matches the hexangular channel 234 to prevent rotation therebetween. The washer 30 is then received in the groove 245 for preventing the second lock 3 from being disengaged from the first lock 2.

Figure 5:
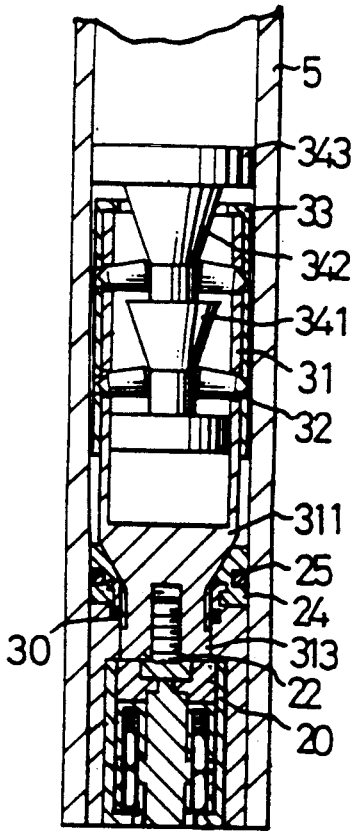
FIG. 5. is a side sectional view of the barrel lock, showing the barrel lock in a locked position and a second lock in a free position.

Referring to FIG. 5, when the tumbler 20 is rotated by a key, the pawl means 21 is rotated because of the engagement of the slot 211 and the linear flange 203. The rods 212 then rotate the screw means 22. The screw 222 thus pulls the second lock 3 toward the first lock 2. The conical end 311 pushes the anchoring means 24 outwardly, thus abutting the anchoring means 24 against the barrel.

Figure 6:
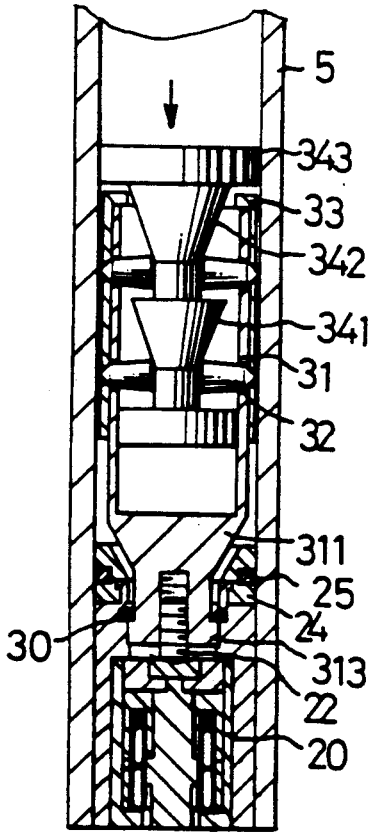
FIG. 6. is a side sectional view of the barrel lock, showing the barrel lock in a locked position and a second lock in an anchored position.

Referring to FIG. 6, when an external load is exerted on the second circular plate 343 the first and the second cone 341 and 342 push the pins 32 outwardly, thereby abutting the barrel, so that a relative movement of the lock 1 and the barrel is restrained. The greater the external force, the firmer the lock 1 is in the barrel.

Figure 3:
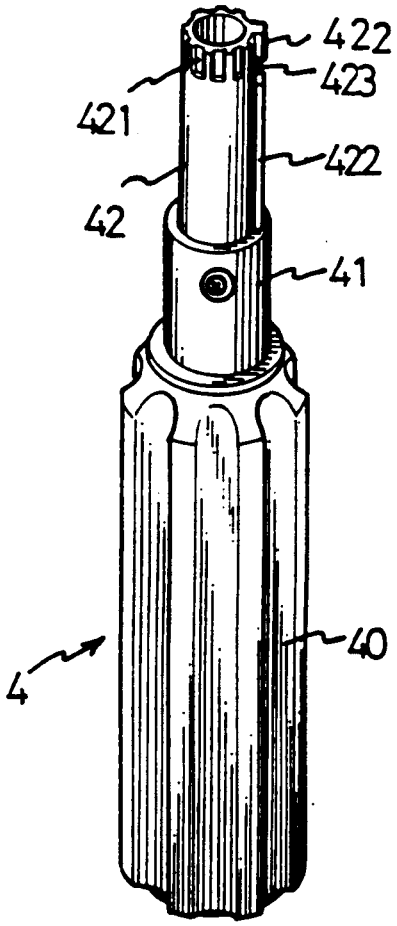
FIG. 3. is a perspective view of a key in accordance with the present application.
Figure 4:
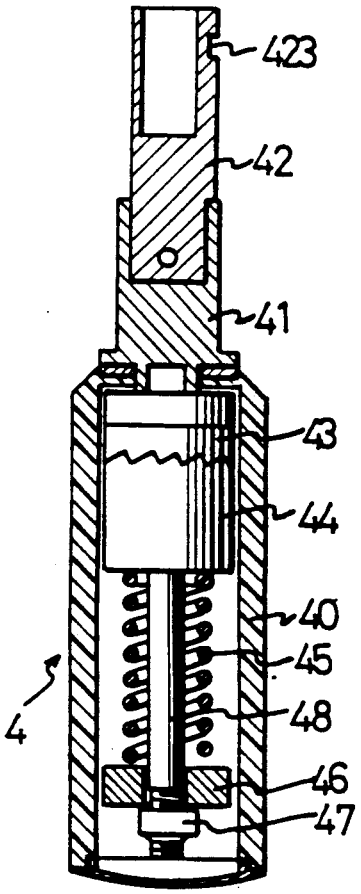
FIG. 4. is a side sectional view of the key.

Referring to FIG. 3 and 4, a key 4 includes a twisting rod 41, a key portion 42, a ratchet disk 43, a ratchet collar 44, a compression spring 45, a washer 46, a nut 47, and a rectangular cross-sectional rod 48.

The key portion 42 has a first end being insertable within the key end 203 and a second end.

The key holder 41 has a first end, co-axially fixed to the key portion 42, and a second end.

The rod 48 has a rectangular cross-section, a first end being co-axially fixed to the second end of the twisting rod 41, and a second end defining a screw.

The tubular handle 40 has a first end formed with a hole through which the rod 48 is insertable and has a recess formed therein.

A ratchet disk 43 has a first end formed with a flange extending along a diameter thereof which matches the recess of the tubular handle 40, and has a second ratchet end and a central circular hole through which the rod 48 is rotatably insertable.

A ratchet collar 44 has a first ratchet end which matches the second ratchet end of the ratchet disk 43, a second end, and a rectangular cross-sectional channel matching the rod 48 for synchronous rotation therewith.

The key portion 43, the key holder 41, and the rod 48 are co-axially fixed. The rod 48 is then inserted in the tubular handle 40 while the key holder 41 is outside thereof. The ratchet disk 43, the ratchet collar 44, the spring 45, and the washer 46 are sequentially inserted onto the rod 48 and enclosed in the tubular handle 40, and the nut 47 is then secured onto the screw of the second end of the rod 48.

While being rotated, the tubular handle 40 rotates the ratchet disk 43 by means of the recess of the tubular handle 40 receiving the flange of the ratchet disk 43. The ratchet disk 43 then rotates the ratchet collar 44 with the ratchet ends thereof engaging with each other. The ratchet collar 44 then rotates the rod 48 by means of the rectangular cross-sectional channel thereof matching that of the rod 48, thus rotating the key portion 42. When the resistant force from the barrel lock on the key 4 reaches a predetermined amount, the ratchet disk 43 will rotate relative to the ratchet collar 44. As will be appreciated, the predetermined amount of force is adjustable by means of securing or slacking the nut 47 on the screw of the second end of the rod 48.

While the present invention has been explained in relation to its preferred embodiment, it is to be understood that various modifications thereof will be apparent to those skilled in the art upon reading this specification and that the invention disclosed herein is intended to cover all such modifications as shall fall within the scope of the appended claims.

I claim:

1. A barrel lock for a gun comprising:

a first lock portion comprising:

a tumbler including a key end through which a key is insertable and an actuating end;

a pawl means including a pawl actuatable by said actuating end and two upright fingers opposed to each other on said pawl;

a screw means actuatable by said pawl means including an upstanding screw and a base including two opposite peripheral cut-outs along which said fingers are slidable;

a sleeve, having said tumbler fixed thereto and enclosing said tumbler, said pawl means and said screw means, including an annular groove formed on an inner periphery thereof, a means for preventing a relative rotation between said barrel lock and a barrel of a gun, and an anchoring neck formed on an end thereof; two semi-circular anchoring means mounted on said anchoring neck; and a flexible means enclosing said anchoring means and allowing an expansion of said anchoring means and restraining a relative longitudinal movement between said anchoring neck and said anchoring means, and a second lock portion comprising:

an apertured cylinder including threading axially extending a portion of a length therein engageable with said screw; a neck for pushing said anchoring means outward when said screw and said thread are engaged in a condition where a distance between said first lock and said second lock is shortest, holes formed therein; and a head axially attached thereto for preventing a relative rotation of said first lock and said second lock when engaged with each other;

a securing means for retaining said cylinder engaged with said sleeve;

an apertured collar including holes corresponding to a hole of said cylinder;

a plurality of pins each being insertable through each said hole on said collar and said corresponding hole of said cylinder; and a column including a first end for resisting an external impact, a middle portion for pushing said pins outward when an impact is exerted on said first end of said column, and a second end for retaining said pins within said cylinder.

2. A barrel lock assembly in accordance with claim 1, wherein said anchoring means has an downwardly tapered conical inner surface matching said cone of said cylinder.

3. A key means for locking and unlocking a barrel lock set forth in claim 1, comprising:

a key including a first end insertable in said key end of said tumbler for co-operation with said key end of said tumbler, an elongated middle portion, and a second screw end;

a tubular handle including an end formed with a hole through which said middle portion of said key is rotatably insertable;

a ratchet disk being enclosed in said tubular handle and fixed thereto including a ratchet surface and a ratchet collar being enclosed in said tubular handle and including a central channel therethrough so that a cross section of said central channel matches a cross section of said middle portion of said key for synchronous rotation with said key, and a first ratchet end engageable with said ratchet surface;

a nut engageable with said screw end of said middle portion of said key; and a flexible element disposed between said second end of said ratchet collar and said nut for exerting a compression therebetween.

* * * * *